US009366075B2

(12) United States Patent
Marsden et al.

(10) Patent No.: US 9,366,075 B2
(45) Date of Patent: Jun. 14, 2016

(54) SECURITY GATE

(71) Applicant: Dorel Juvenile Group, Inc., Foxboro, MA (US)

(72) Inventors: Andrew W Marsden, Hingham, MA (US); Raul G Pereira, Cumberland, RI (US)

(73) Assignee: Dorel Juvenile Group, Inc., Foxboro, MA (US)

( * ) Notice: Subject to any disclaimer, the term of this patent is extended or adjusted under 35 U.S.C. 154(b) by 0 days.

(21) Appl. No.: 14/502,718

(22) Filed: Sep. 30, 2014

(65) Prior Publication Data

US 2015/0089873 A1 Apr. 2, 2015

Related U.S. Application Data

(60) Provisional application No. 61/884,838, filed on Sep. 30, 2013.

(51) Int. Cl.

| | |
|---|---|
| ***E06B 9/04*** | (2006.01) |
| ***E05B 65/00*** | (2006.01) |
| ***E06B 9/02*** | (2006.01) |
| *E06B 9/00* | (2006.01) |

(52) U.S. Cl.

CPC ..... *E06B 9/04* (2013.01); *E05B 65/0014* (2013.01); *E06B 9/02* (2013.01); *E06B 2009/002* (2013.01)

(58) Field of Classification Search

CPC ..... E06B 9/02; E06B 9/06; E06B 9/0607; E06B 9/0653; E06B 9/0676; E06B 9/063; E06B 9/0623; E06B 9/0638; E06B 9/04

USPC ..... 160/216, 22, 223, 225–228

See application file for complete search history.

(56) References Cited

U.S. PATENT DOCUMENTS

| | | | | | |
|---|---|---|---|---|---|
| 683,307 | A * | 9/1901 | Linck | E06B 9/522 | 160/225 |
| 1,120,361 | A * | 12/1914 | Bauer | E06B 9/522 | 160/224 |
| 2,113,310 | A * | 4/1938 | Peters | E06B 9/522 | 160/226 |
| 2,819,500 | A * | 1/1958 | Saber | E06B 9/01 | 160/225 |
| 2,998,063 | A * | 8/1961 | Hafner | 160/216 | |
| 4,680,890 | A * | 7/1987 | Jokel | 49/55 | |
| 4,688,619 | A * | 8/1987 | Kessler | E06B 9/522 | 160/225 |
| 4,831,777 | A | 5/1989 | Johnson, Jr. | | |
| 4,884,614 | A * | 12/1989 | Spurling | 160/225 | |
| 5,117,585 | A * | 6/1992 | Andrisin, III | 49/55 | |
| 6,112,460 | A | 9/2000 | Wagnitz | | |
| 6,178,694 | B1 | 1/2001 | Wagnitz | | |
| 6,233,874 | B1 | 5/2001 | Johnson, Jr. | | |
| 6,536,163 | B1 | 3/2003 | Monahan et al. | | |
| 6,658,678 | B2 | 12/2003 | Hotaling et al. | | |
| 6,711,857 | B1 | 3/2004 | Wagnitz et al. | | |
| 7,318,298 | B2 | 1/2008 | Marsden et al. | | |
| 7,627,985 | B2 | 12/2009 | Marsden et al. | | |
| 8,261,490 | B2 * | 9/2012 | Flannery et al. | 49/55 | |
| 8,733,017 | B2 | 5/2014 | Marsden et al. | | |
| 2008/0127556 | A1 * | 6/2008 | Trujillo et al. | 49/28 | |
| 2010/0290830 | A1 * | 11/2010 | Cheng | 403/290 | |
| 2013/0086840 | A1 | 4/2013 | Marsden et al. | | |
| 2013/0269271 | A1 * | 10/2013 | Webb | 52/202 | |
| 2014/0007506 | A1 * | 1/2014 | Huang | E06B 3/32 | 49/149 |

* cited by examiner

*Primary Examiner* — Katherine Mitchell
*Assistant Examiner* — Catherine A Kelly
(74) *Attorney, Agent, or Firm* — Barnes & Thornburg LLP

(57) ABSTRACT

A gate is mounted to pivot about a pivot axis between opened and closed positions. The gate includes a pivotable first panel and a movable second panel coupled to the pivotable first panel.

20 Claims, 5 Drawing Sheets

Figures 1, 2:
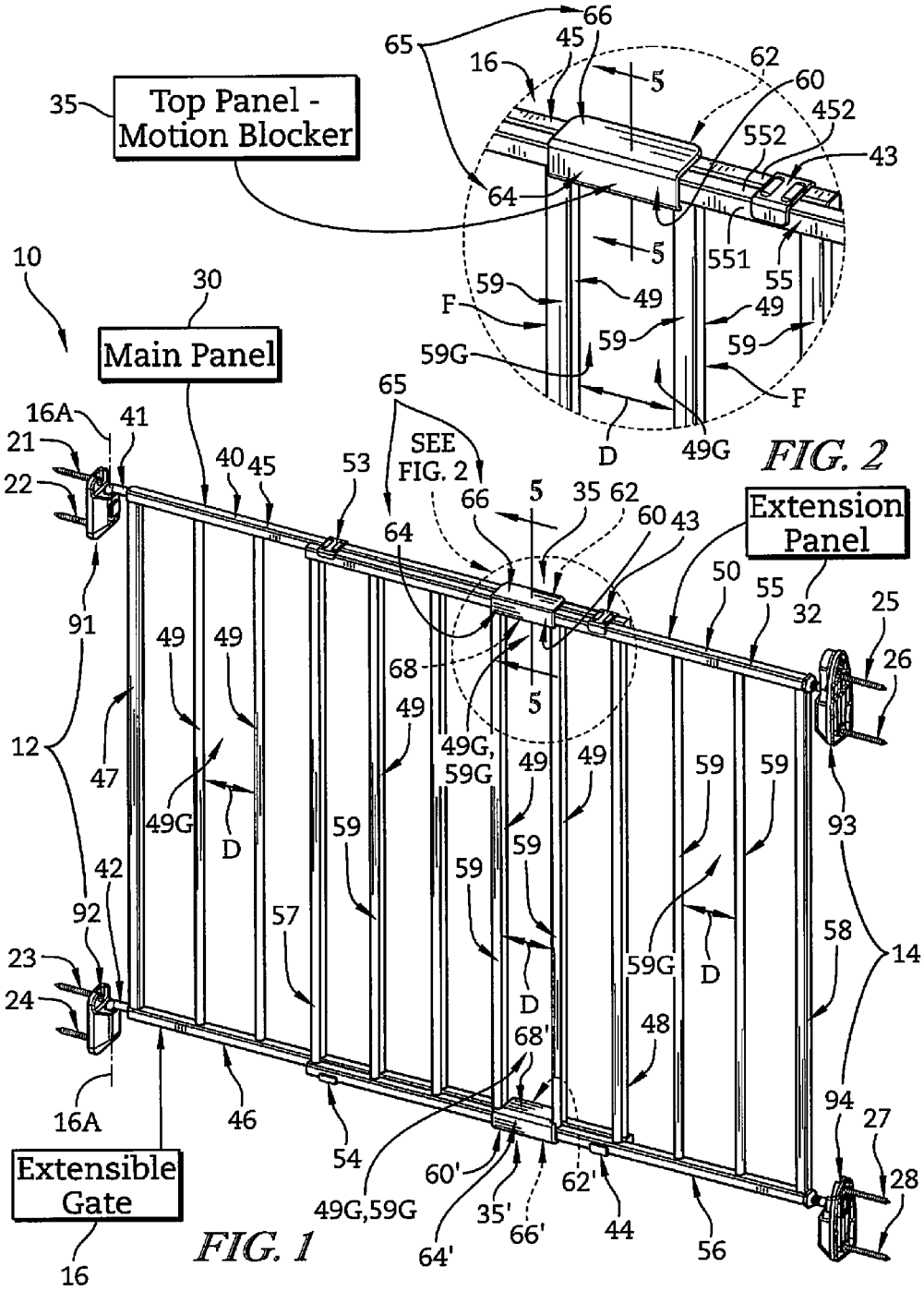

Top Panel - Motion Blocker
Main Panel
Extension Panel
Extensible Gate
SEE FIG. 2

SECURITY GATE

PRIORITY CLAIM

This application claims priority under 35 U.S.C. §119(e) to U.S. Provisional Application Ser. No. 61/884,838, filed Sep. 30, 2013, which is expressly incorporated by reference herein.

BACKGROUND

The present disclosure relates to security gates and, in particular, to juvenile security gate units for use inside a dwelling. More particularly, the present disclosure relates to security gate units adapted to be extended or retracted for use in blocking openings of various sizes.

SUMMARY

A security gate unit includes an extensible gate adapted to be widened or narrowed so that the gate unit may be used to block openings of various widths to prevent children and pets from moving through the opening without supervision. In illustrative embodiments, the gate unit further includes a gate mount adapted to mate with a door frame or other structure and the extensible gate is adapted to be supported for pivotable on the gate mount to close an opening defined by the door frame. The extensible gate includes a main panel and a slidable extension panel. The extension panel is coupled to the main panel to slide relative to the main panel so that the width of the extensible gate can be changed by a caregiver.

In illustrative embodiments, the extensible gate further includes a pair of panel-motion blockers. Each panel-motion blocker is engaged with the main panel and the extension panel along one of the top and bottom rails of the main panel and the extension panel. Each of the panel-motion blockers is configured to provide means for blocking sliding movement of the extension panel relative to the main panel so that the width of the gate is maintained during pivoting movement of the gate on the gate mount about a vertical pivot axis.

In illustrative embodiments, each panel-motion blocker is a monolithic component made of an elastic plastics material and formed to include a C-shaped rail receiver and a retainer coupled to the rail receiver. The rail receiver receives either the top rails (or the bottom rails) of the panels and includes a spindle-motion limiter that is sized to extend through spindle gaps formed between a pair of adjacent vertically-extending spindles included in the panels to block horizontal sliding movement of the extension panel relative to the main panel. The retainer is configured to block removal of the corresponding rail receiver from the top rails (or bottom rails) included in the panels without the use of bolts, screws, or other fasteners.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

Figure 1A:
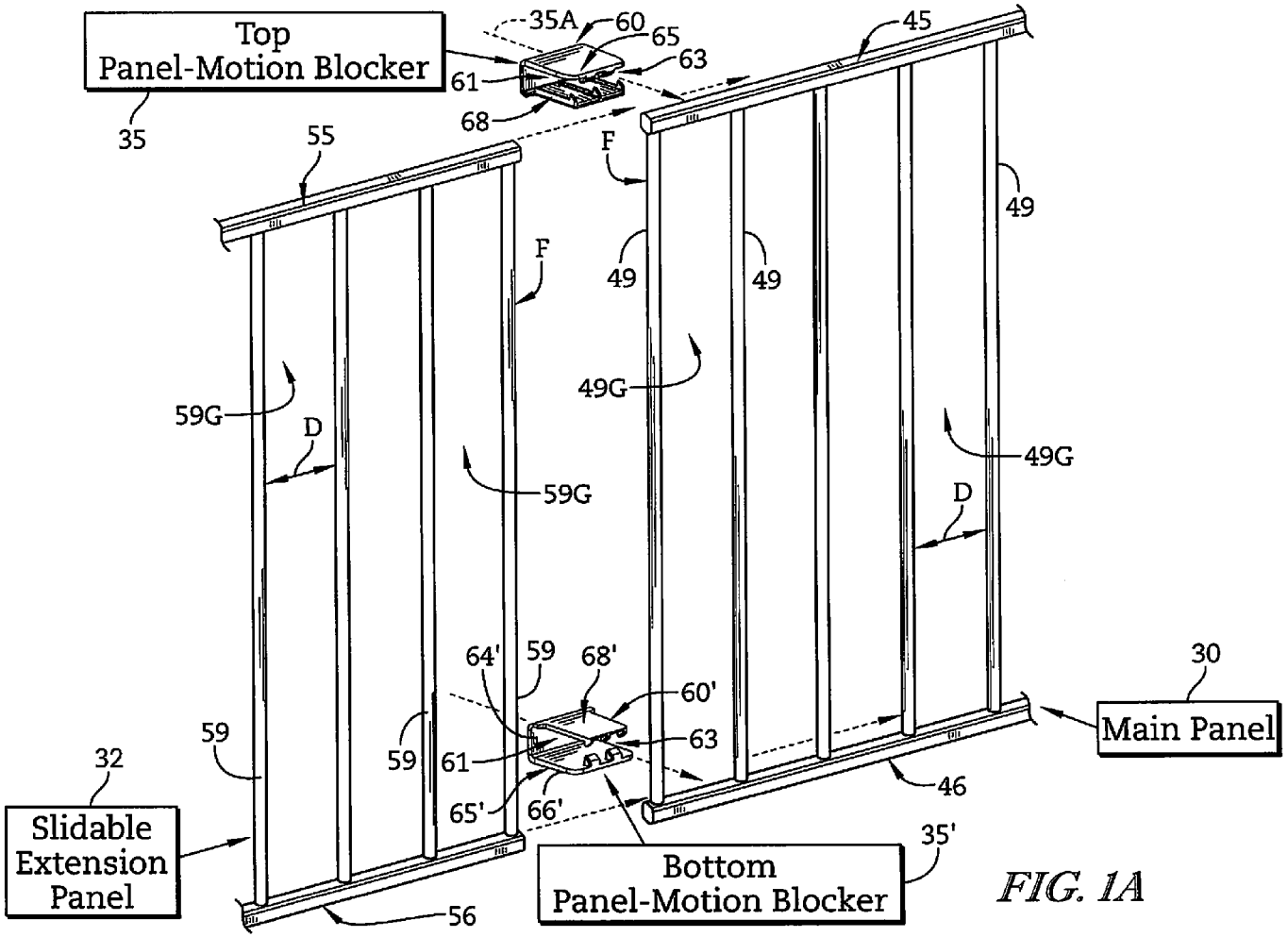
Figure 2A:
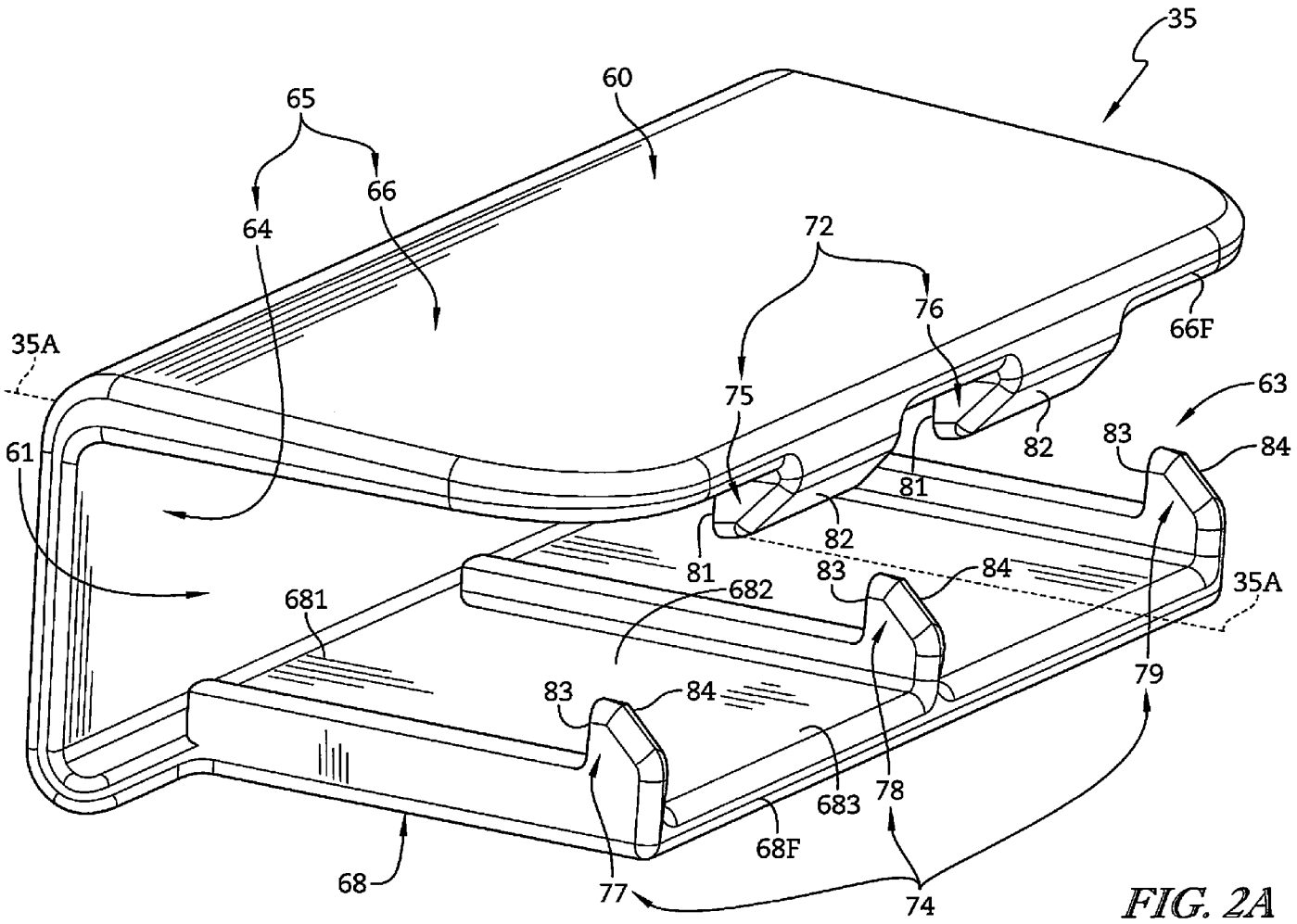
Figure 3:
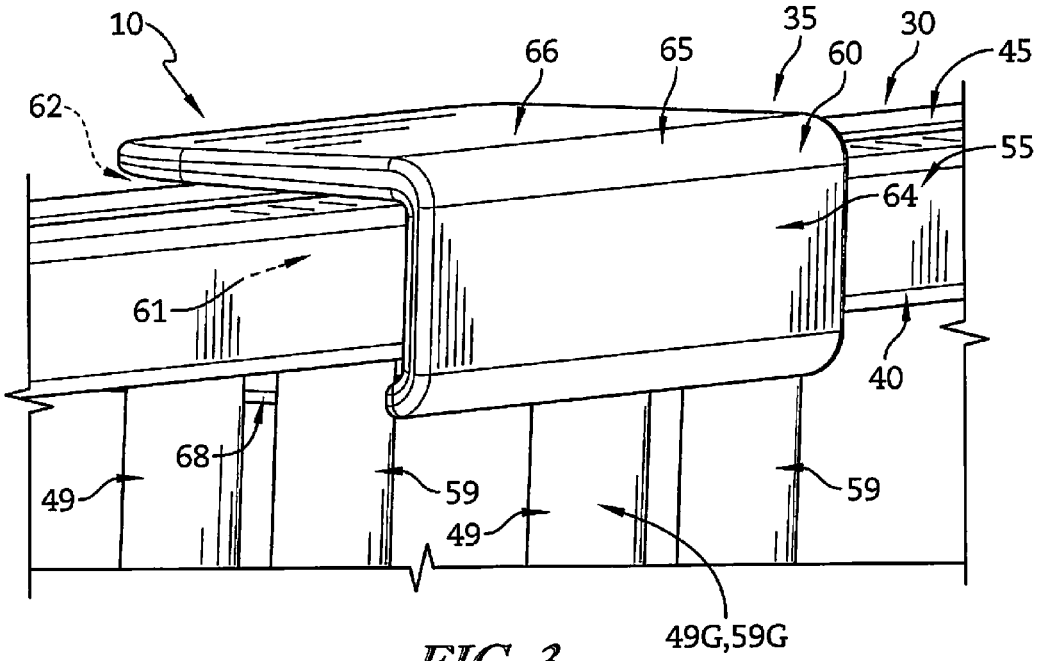
Figure 4:
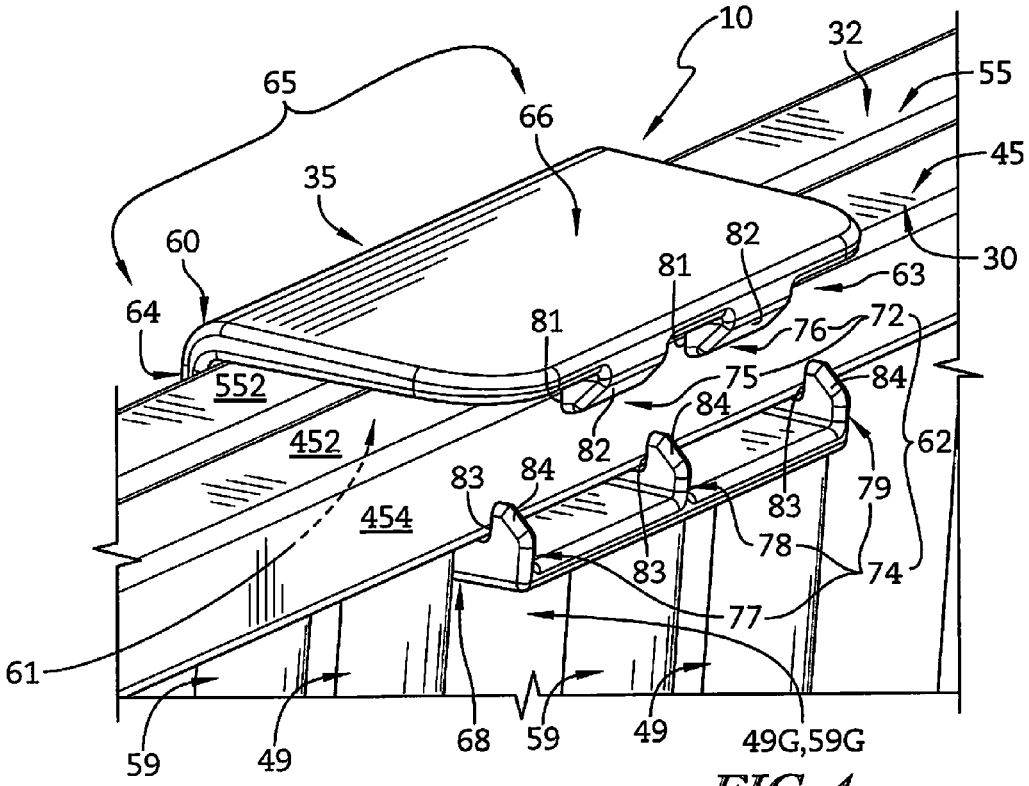
Figure 5:
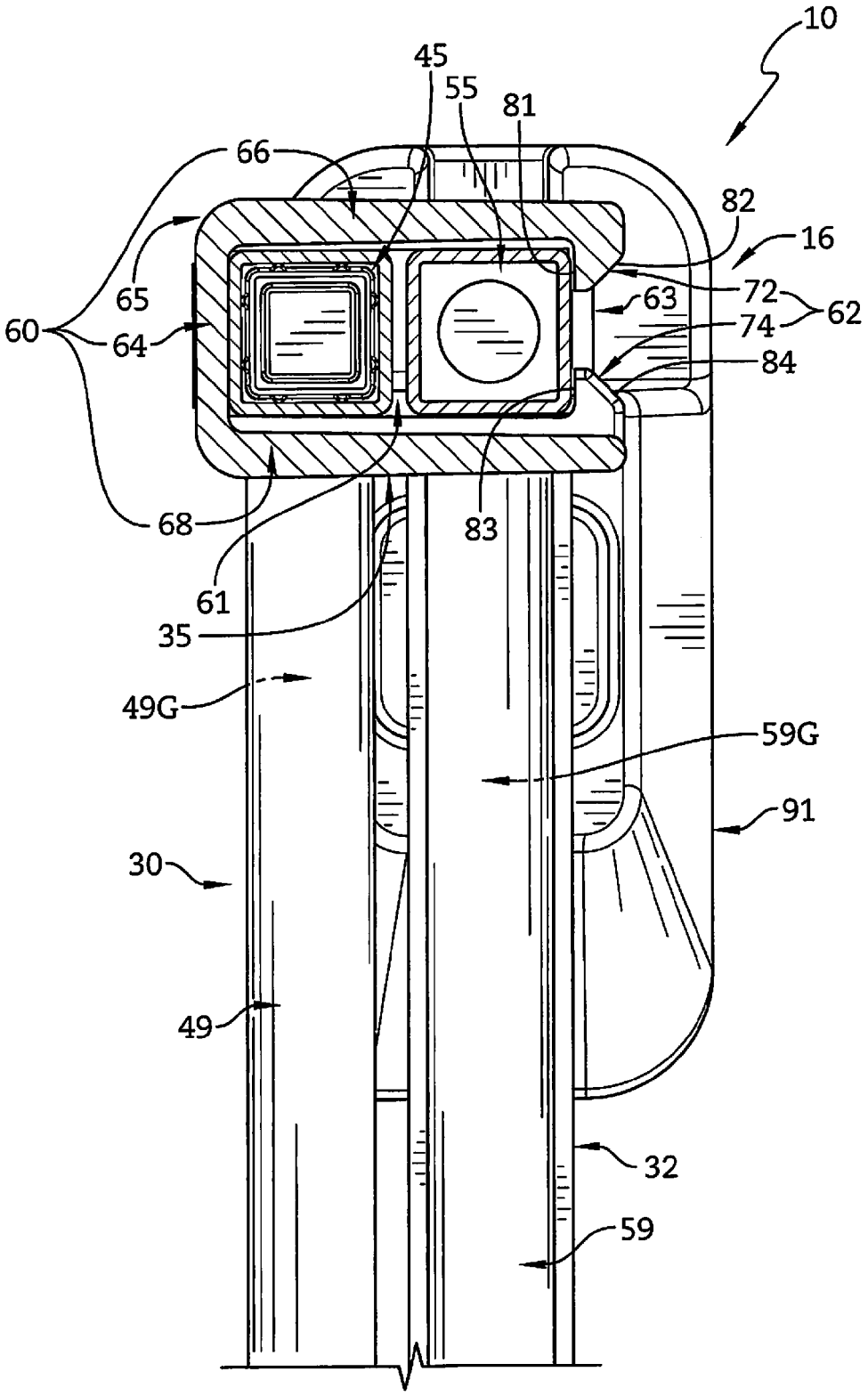

The detailed description particularly refers to the accompanying figures in which:

FIG. 1 is a perspective view of a security gate unit showing that the gate unit includes a gate mount (on the left) adapted to be coupled to a door frame along a first side of a doorway opening, a gate retainer (on the right) adapted to be coupled to a door frame along a second side of a doorway opening, and an extensible gate coupled at one end to the gate mount for pivotable movement about a gate-pivot axis and coupled at another end to the gate retainer to block pivoting movement of the gate about the gate-pivot axis, and showing that the gate includes a main panel pivotably coupled to the gate mount, an extension panel coupled to the main panel to slide relative to the main panel to widen or narrow the width of the gate, a snap-on top panel-motion blocker coupled to the top rails of the panels, and a snap-on bottom panel-motion blocker coupled to the bottom rails of the panels and arranged to lie directly below the top panel-motion blocker;

FIG. 1A is an exploded perspective assembly view of a portion of the gate unit of FIG. 1 showing the slidable extension panel before it is mounted on the main panel to slide back and forth on the main panel and showing a snap-on top panel-motion blocker before it is mounted on the top rails of the main and extension panels and a separate snap-on bottom panel-motion blocker before it is mounted on the bottom rails of the main and extension panels;

FIG. 2 is a detail perspective view of a portion of the gate unit of FIG. 1 showing the top panel-motion blocker mounted on the main panel and the extension panel to provide means for extending through a first spindle gap formed between two adjacent spindles of the main panel and through a second spindle gap formed between two adjacent spindles of the extension panel to block sliding movement of the extension panel relative to the main panel so that a constant width of the gate is maintained during pivoting movement of the gate on the gate mount about the gate-pivot axis;

FIG. 2A is an enlarged perspective view of the top panel-motion blocker of FIG. 1 before it is mounted on the main panel and the extension panel and showing that the top panel-motion blocker includes a C-shape rail receiver comprising a horizontally extending exterior deck, a horizontally extending spindle-motion limiter (interior deck) that is arranged to lie under the exterior deck and is narrower than the exterior deck and sized to extend through spindle gaps formed in the main and extension panels, a vertically extending deck-support spine coupled to left ends of the exterior deck and the spindle-motion limiter (interior deck), and a retainer including three limiter barbs coupled to a free end portion of the spindle-motion limiter (interior deck) and two deck barbs coupled to a free end portion of the exterior deck;

FIG. 3 is an enlarged front detail perspective view of a portion of the gate unit of FIG. 1 showing that a top panel-motion blocker receives the top rails of the main panel and the extension panel and showing that the rail receiver includes a spindle-motion limiter that is sized to extend through spindle gaps defined between spindles extended downwardly from the top rails of the main panel and the extension panel to block horizontal sliding movement of the extension panel relative to the main panel so that the gate will not widen or narrow while pivoting about the gate-pivot axis;

FIG. 4 is a rear detail perspective view of a portion of the gate unit of FIG. 1 showing that the top panel-motion blocker is formed to include a retainer coupled to the C-shaped rail receiver to block movement of the rail receiver away from the top rails of both the main panel and the extension panel without the use of bolts, screws, or other fasteners; and FIG. 5 is a cross-sectional view of a portion of the gate unit of FIG. 1 taken along line 5-5 showing that the retainer of the top panel-motion blocker includes a plurality of barbs formed to include outwardly-facing installation ramps for temporarily spreading the exterior deck and the spindle-motion limiter (interior deck) apart to cause the C-shaped rail receiver to open when the top panel-motion blocker is pushed into engagement with the panels and inwardly-facing retention surfaces that block movement of the rail receiver away from the top rails of the panels after the top rails are inserted into a rail-receiving space provided between the exterior deck and the spindle-motion limiter (interior deck).

DETAILED DESCRIPTION

A gate unit 10 includes an extensible gate 16 shown, for example, in FIG. 1 that is adapted to be widened or narrowed by a caregiver to block openings of various widths. Extensible gate 16 includes a main panel 30 and a slidable extension panel 32 shown in FIG. 1A and supported for lateral sliding movement relative to main panel 30 to vary the width of extensible gate 16 to fit wide or narrow doorways. Top and bottom panel-motion blockers 35, 35' are provided in accordance with the present disclosure as shown in FIG. 1A to mount on horizontal rails include in panels 30, 32 and between vertical spindles included in panels 30, 32 as suggested in FIG. 1 to block relative movement of panels 30, 32 and provide extensible gate 16 with a width selected in advance by a caregiver to fit a doorway.

Main panel 30 includes a horizontal top rail 45, a horizontal bottom rail 46, and several vertical spindles 49 interconnecting top and bottom rails 45, 46 as suggested in FIGS. 1 and 1A. Each pair of adjacent spindles 49 cooperate to form a spindle gap 49G therebetween.

Extension panel 32 includes a horizontal top rail 55, a horizontal bottom rail 56, and several vertical spindles 59 interconnecting top and bottom rails 55, 56 as suggested in FIGS. 1 and 1A. Each pair of adjacent spindles 59 cooperate to form a spindle gap 59G therebetween.

Top panel-motion blocker 35 is configured to be coupled to the top rails 45, 55 of main panel 30 and extension panel 32 as suggested in FIGS. 1 and 1A. Top panel-motion blocker 35 includes a spindle-motion limiter (interior deck) 68 that extends into a first spindle gap 49G formed between two adjacent spindles 49 in main panel 30 and into a second spindle gap 59G formed between two adjacent spindles 59 in extension panel 32 to block lateral sliding movement of extension panel 32 relative to main panel 30 to establish the selected width of extensible gate 16.

Bottom panel-motion blocker 35' is configured to be coupled to the bottom rails 46, 56 of main panel 30 and extension panel 32 as suggested in FIGS. 1 and 1A. Bottom panel-motion blocker 35' includes a spindle-motion limiter (interior deck) 68' that extends into a first spindle gap 49G formed between two adjacent spindles 49 in main panel 30 and into a second spindle gap 59G formed between two adjacent spindles 59 in extension panel 32 to block lateral sliding movement of extension panel 32 relative to main panel 30. In illustrative embodiments, as suggested in FIGS. 1 and 1A, top panel-motion blocker 35 is mounted on panels 30, 32 of extensible gate 16 to lie directly above bottom panel-motion blocker 35' so that each of top spindle-motion limiter 68 and bottom spindle-motion limiter 68' extend into and through the same first and second spindle gaps 49G, 59G.

Each of top and bottom panel-motion blockers 35, 35' is a monolithic element made of an elastic plastics material and can be snapped in place easily on top rails 45, 55 or bottom rails 46, 56 of main and extension panels 30, 32 by a caregiver to anchor extension panel 32 in a stationary position on main panel 30 to establish the width of extensible gate 16 as shown, for example, in FIG. 1. Snap-on top panel-motion blocker 35 can be used on top rails 45, 55 of main and extension panels 30, 32 as suggested in FIGS. 1 and 1A and then rotated 180° about a central axis 35A as suggested in FIGS. 1A and 2A to provide the snap-on bottom panel-motion blocker 35' that is oriented and arranged to be mounted on bottom rails 46, 56 of main and extension panels 30, 32.

Gate unit 10 also includes a gate mount 12 adapted to mate with a door frame (not shown) and support main panel 30 for pivotable movement about a vertical gate-pivot axis 16A as suggested in FIG. 1. A fixed latch is carried on a free end of extension panel 32 and configured to engage a gate retainer 14 mounted on an opposite portion of the door frame to block pivoting motion of main and extension panels 30, 32 of extensible gate 16 about gate-pivot axis 16A.

Top panel-motion blocker 35 can be used as bottom panel-motion blocker 35' as noted herein simply by rotating blocker 35 through an angle of 180° about central axis 35A. Accordingly, what follows is a description of the structure and operation of top panel-motion blocker 35, and this description can be applied to bottom panel-motion blocker 35'.

Top panel-motion blocker 35 includes a C-shaped rail receiver 60 comprising a spindle-motion limiter (interior deck) 68 and a limiter support 65 as suggested in FIGS. 1, 2, and 2A. Spindle-motion limiter 68 is arranged to extend through a first spindle gap 49G formed in the main panel 30 and a second spindle gap 59G formed in the extension panel 32 and aligned to lie in side-by-side relation to the first spindle gap 4G formed in the main panel 30 as suggested in FIGS. 4 and 5. Limiter support 65 is coupled to the top rails 46, 56 of the main and extension panels 30, 32 and configured to provide means for supporting the spindle-motion limiter (interior deck) 68 in the first and second spindle gaps 49G, 59G to engage spindles 49, 59 of the main and extension panels 30, 32 defining those first and second spindle gaps 49G, 59G during attempted lateral sliding movement of the extension panel 32 relative to the main panel 30 so that such lateral sliding movement is blocked to provide the extensible gate 16 with a width selected by a caregiver to fit a doorway.

Limiter support 65 includes an exterior deck 66 and a deck-support spine 64 as shown, for example, in FIG. 2A. Exterior deck 66 is arranged to lie in spaced-apart relation to spindle-motion limiter (interior deck) 68 to locate and trap top rails 45, 55 of the main and extension panels 30, 32 therebetween to fix the spindle-motion limiter 68 in a substantially stationary position in the first spindle gap 49G formed in main panel 30 and the second spindle gap 59G formed in extension panel 32. Deck-support spine 64 is coupled to each of the exterior deck 66 and the spindle-motion limiter 68 to retain exterior deck 66 and spindle-motion limiter 68 in substantially stationary positions relative to one another as suggested in FIG. 2A and to the main and extension panels 30, 32 as suggested in FIGS. 1 and 2 to block lateral sliding movement of extension panel 32 relative to main panel 30.

Exterior deck 66 includes a free end edge 66F arranged to lie in spaced-apart relation to the deck-support spine 64 as suggested in FIG. 2A. Spindle-motion limiter 68 defines an interior deck that is narrower than the overlying exterior deck 66 as shown in FIG. 2A. Interior deck 68 is arranged to extend through the first and second spindle gaps 49G, 59G and terminate at a free end edge 68F arranged to lie in spaced-apart relation to the deck-support spine 64 and cooperate with the free end edge 66F of the exterior deck 66 to define a rail-receiving mouth 63 therebetween that is arranged to open in a direction facing away from the deck-support spine 64 as shown, for example, in FIG. 2.

Deck-support spine 64 is made of an elastic material to allow movement of the exterior deck 66 relative to the spindle-motion limiter (interior deck) 68 during insertion of the top rails 45, 55 of the main and extension panels 30, 32 into a rail-receiving space 61 bounded by the exterior deck 66, interior deck 68, and deck-support spine 64 through the rail-receiving mouth 63 as shown, for example, in FIGS. 2A and 5.

Top panel-motion blocker 35 further includes a retainer 62 configured to provide rail-engagement means coupled to the free end edges 66F, 62F of the exterior and interior decks 66, 68 for temporarily spreading the free end edges 66F, 68F of the exterior and interior decks 66, 68 apart during insertion of the top rails 45, 55 of the main and extension panels 30, 32 into the rail-receiving space 61 through the rail-receiving mouth 63 in a direction toward the deck-support spine 64 and for retaining the top rails 45, 55 of the main and extension panels 30, 32 in the rail-receiving space 61 upon arrival therein to fix the spindle-motion limiter (interior deck 68) in a substantially stationary position in the first and second spindle gaps 49G, 59G. The rail-engagement means includes an interior barb 77 and an exterior barb 75 as suggested in FIGS. 2A and 4. Interior barb 77 is coupled to the free end edge 68F of the interior deck 68 and formed to include an inclined rail-camming ramp 84 facing away from the deck-support spine 64 and a rail-retaining stop wall 83 facing toward the deck-support spine 64 as shown in FIG. 2A. Exterior barb 75 is coupled to the free end edge 68F of the exterior deck 68 and formed to include an inclined rail-camming ramp 82 facing away from the deck-support spine 64 and a rail-retaining stop wall 81 facing toward the deck-support spine 64 as also shown in FIG. 2A. In illustrative embodiments, two other interior barbs 78, 79 are coupled to free end edge 68F of interior deck 68 and another exterior barb 76 is coupled to free end edge 66F of exterior deck 66.

Top panel-motion blocker 35 further includes a retainer 62 coupled to at least one of the exterior deck 66 and the spindle-motion limiter 68 to retain the top panel-motion blocker 35 in a mounted position on the top rails 45, 55 of the main and extension panels 30, 32 and to retain the spindle-motion limiter 68 in a substantially stationary position in the first and second spindle gaps 49G, 59G to block relative movement of the main and extension panels 30, 32. Deck-support spine 64 is coupled to each of the exterior deck 66 and the spindle-motion limiter 68 and arranged to lie in spaced-apart relation to the retainer 62 to define a rail-receiving space 61 therebetween as shown, for example, in FIG. 2. Portions of the top rails 45, 55 of the main and extension panels 30, 32 are retained in the rail-receiving space 61 between the deck-support spine 64 and the retainer 62 and between the exterior deck 66 and the spindle-motion limiter 68 when the top panel-motion blocker 35 is mounted on the top rails 45, 55 of the main and extension panels 30, 32.

Main panel 30 includes a first spindle-gap frame arranged to border first spindle gap 49G, as suggested in FIGS. 1A and 2. First spindle-gap frame is formed to include a main aperture bordered by a first spindle 49 of the main panel 30, an adjacent second spindle 49 of the main panel 30 that is arranged to lie in spaced-apart relation to the first spindle 49 of the main panel 30 to define the first spindle gap 49G therebetween, a portion of the top rail 45 of the main panel 30 coupled to the first and second spindles 49, 49 of the main panel 30, and a portion of the bottom rail 46 of the main panel 30 coupled to the first and second spindles 49, 49 of the main panel 30.

Extension panel 32 includes a second spindle-gap frame arranged to border second spindle gap 59G as suggested in FIGS. 1A and 2. Second spindle-gap frame is formed to include an extension aperture bordered by a first spindle 59 of the extension panel 32, an adjacent second spindle 59 of the extension panel 32 that is arranged to lie in spaced-apart relation to the first spindle 59 of the extension panel 32 to define the second spindle gap 59G therebetween, a portion of the top rail 55 of the extension panel 32 coupled to the first and second spindles 59 of the extension panel 32, and a portion of the bottom rail 56 of the extension panel 32 coupled to the first and second spindles 59, 59 of the extension panel 32. Spindle-motion limiter (interior deck) 68 is arranged to extend through the main aperture formed in the first spindle-gap frame of the main panel 30 and through the extension aperture formed in the second spindle-gap frame the extension panel 32 as suggested in FIGS. 4 and 5.

Spindle-motion limiter (interior deck) 68 includes a proximal portion 681 coupled to the limiter support 65 and arranged to lie outside of the main aperture formed in the first spindle-gap frame 30F of the main panel 30, a free-end portion 683 arranged to lie in spaced-apart relation to the proximal portion 681 in a position outside of the extension aperture formed in the second spindle-gap frame 32F of the extension panel 32, and a central portion 682 arranged to interconnect the proximal and free-end portions 381, 382 and extend through the main and extension apertures. Exterior deck 66 is arranged to lie in spaced-apart relation to the central portion 682 of the spindle-motion limiter (interior deck) 68 to locate therebetween the top rails 45, 55 of the main and extension panels 30, 32. Deck-support spine 64 is arranged to interconnect the proximal portion 681 of the spindle-motion limiter 68 and the exterior deck 66 to locate the top rails 45, 55 of the main and extension panels 30, 32 between the exterior deck 66 and the central portion 682 of the spindle-motion limiter (interior deck) 68.

Retainer 62 is coupled to the free-end portion 683 of the spindle-motion limiter 68 and to the exterior deck 66 to lie in spaced-apart relation to the deck-support spine 64 to locate the top rails 45, 55 of the main and extension panels 30, 32 in a rail-receiving space 61 bounded by the central portion 682 of the spindle-motion limiter 68, the deck-support spine 64, the exterior deck 66, and the retainer 62 to retain the top panel-motion blocker 35 in a mounted position on the main and extension panels 30, 32 and the central portion 682 of the spindle-motion limiter 68 in the main aperture and the extension aperture to block lateral sliding movement of the extension panel 32 relative to the main panel 30. Retainer 62 includes a limiter grip 74 coupled to the free-end portion 683 of the spindle-motion blocker (interior deck) 68 and arranged to extend toward the exterior deck 66 and to lie in spaced-apart relation to the deck-support spine 64 to trap the top rails 45, 55 of the main and extension panels 30, 32 therebetween. Retainer 62 includes a deck grip 72 coupled to the exterior deck 66 and arranged to extend toward the free-end portion 683 of the spindle-motion blocker (interior deck) 68 and to lie in spaced-apart relation to the deck-support spine 64 to trap the top rails 45, 55 of the main and extension panels 30, 32 therebetween.

An illustrative security gate unit 10 is adapted to block an opening in a dwelling so that children and pets may be blocked from moving through the opening without supervision as suggested in FIG. 1. The gate unit 10 includes a gate mount 12, a gate retainer 14, and an extensible gate 16 that extends from pivot mount 12 to gate retainer 14 as shown in FIG. 1. Gate mount 12 is adapted to be coupled to a wall along a first side of an opening by fasteners 21, 22, 23, 24 and is adapted to support extensible gate 16 for pivotable movement about a gate-pivot axis 16A. Gate retainer 14 is adapted to be coupled to a door frame (not shown) along a second side of an opening by fasteners 25, 26, 27, 28 and is adapted to either block or allow movement of extensible gate 16 about gate-pivot axis 16A. Extensible gate 16 can be widened or narrowed to accommodate different distances between gate mount 12 and gate retainer 14 so that gate unit 10 may be used to block doorway openings of various widths.

Extensible gate 16 illustratively includes a main panel 30, an extension panel 32, and a pair of snap-on panel-motion blockers 35, 35' as shown in FIG. 1. Main panel 30 is coupled to gate mount 12 for movement about gate-pivot axis 16A. Extension panel 32 is coupled to main panel 30 for pivotable movement with main panel 30 about gate-pivot axis 16A. Extension panel 32 is also coupled to main panel 30 to slide relative to main panel 30 toward and away from gate-pivot axis 16A as suggested by arrow 32A to widen or narrow the width of extensible gate 16. Panel-motion blockers 35, 35' are engaged with main panel 30 and extension panel 32 and provide means for blocking sliding movement of extension panel 32 relative to main panel 30 so that the width of extensible gate 16 is maintained during pivotable movement of extensible gate 16 about gate-pivot axis 16A.

Main panel 30 illustratively includes partition frame 40, top and bottom pivot pegs 41, 42, and top and bottom rail guides 43, 44 as shown in FIG. 1. Partition frame 40 is adapted to block all or a portion of the width of a doorway in a dwelling. Top and bottom pivot pegs 41, 42 are coupled to partition frame 40 and are engaged with gate mount 12 for rotative bearing engagement so that main panel 30 pivots about gate-pivot axis 16A. Top and bottom rail guides 43, 44 are coupled to partition frame 40 and are engaged with extension panel 32 to guide sliding movement of extension panel 32 relative to main panel 30.

Partition frame 40 of main panel 30 is illustratively rectangular and includes a top rail 45, a bottom rail 46, a left side rail 47, a right side rail 48, and a plurality of spindles 49 as shown in FIG. 1. Top rail 45 and bottom rail 46 extend horizontally and are spaced vertically apart. Left and right side rails 47, 48 extend vertically and interconnect the ends of top and bottom rails 45, 46. Spindles 49 extend vertically and interconnect top rail 45 and bottom rail 46. Each spindle 49 is equidistantly spaced a distance D from adjacent spindles 49 or side rails 47, 48.

Extension panel 32 illustratively includes partition frame 50, top and bottom latch pins 51, 52, and top and bottom rail guides 53, 54 as shown in FIG. 1. Partition frame 50 overlaps at least a portion of partition frame 40 included in main panel 30 and is adapted to block all or a portion of the width of an opening in a dwelling. Top and bottom latch pins 51, 52 are coupled to partition frame 50 and are selectively engaged by latch 14 so that extensible gate 16 is blocked or allowed to pivot about gate-pivot axis 16A. Top and bottom rail guides 53, 54 are coupled to partition frame 50 and engage main panel 30 to guide sliding movement of extension panel 32 relative to main panel 30.

Partition frame 50 of extension panel 32 is similar to partition frame 40 of main panel 30 and includes a top rail 55, a bottom rail 56, a left side rail 57, a right side rail 58, and a plurality of spindles 59 as shown in FIG. 1. Top rail 55 and bottom rail 56 extend horizontally and are spaced vertically apart. Left and right side rails 57, 58 extend vertically and interconnect the ends of top and bottom rails 55, 56. Spindles 59 extend vertically and interconnect top rail 55 and bottom rail 56. Each spindle 59 is equidistantly spaced distance D from adjacent spindles 59 or side rails 57, 59.

Top panel-motion blocker 35 engages top rails 45, 55 of partition frames 40, 50 included in panels 30, 32 and extends between a pair of spindles 49, 59 included in panels 30, 32 over the distance D between the spindles 49, 59 as shown in FIG. 1. Bottom panel-motion blocker 35' engages bottom rails 46, 56 of partition frames 40, 50 included in panels 30, 32 and extends between a pair of spindles 49, 59 included in panels 30, 32 over the distance D between the spindles 49, 59 as shown in FIG. 2. By extending through spindle gaps 49G, 59G defined by between spindles 49, 59, top and bottom panel-motion blockers 35, 35' cooperate to block sliding movement of extension panel 32 relative to main panel 30 so that the width of extensible gate 16 is maintained during pivotable movement of extensible gate 16 about gate-pivot axis 16A.

Top panel-motion blocker 35 is illustratively a monolithic component made of an elastic plastics material as suggested in FIGS. 3 and 4. Top panel-motion blocker 35 includes a C-shaped rail receiver 60 and a retainer 62 as shown, for example, in FIGS. 3 and 4. Rail receiver 60 forms a channel 61 that receives top rails 45, 55 of panels 30, 32 and is sized to extend between spindles 49, 59 of panel 30, 32 to block horizontal movement of extension panel 32 relative to main panel 30 so that extensible gate 16 will not change width while pivoting about gate-pivot axis 16A. Retainer 62 blocks movement of top rail receiver 60 away from top rails 45, 55 of panels 30, 32 without the use of bolts, screws, or other fasteners.

Rail receiver 60 illustratively includes a deck-support spine 64, an exterior deck 66, and a spindle-motion limiter (interior deck) 68 as shown in FIG. 3. Deck-support spine 64 extends over a front side 551 of top rail 55 included in extension panel 32. Exterior deck 66 extends rearwardly from deck-support spine 64 over exterior sides 452, 552 of top rails 45, 55 included in panels 30, 32. Spindle-motion limiter 68 extends rearwardly from deck-support spine 64 over an interior side 453, 553 of top rails 45, 55 included in panels 30, 32. Spindle-motion limiter 68 is sized to extend through spindle gaps 49G, 59G formed between adjacent pairs of spindles 49, 59 included in panels 30, 32 and has a width of about distance D so that spindle-motion limiter 68 blocks sliding movement of extension panel 32 relative to main panel 30 as shown in FIGS. 3 and 4.

Retainer 62 engages a back side 454 of main panel 30 to block movement of top panel-motion blocker 35 away from top rails 45, 55 of panels 30, 32 without the use of bolts, screws, or other fasteners as shown in FIG. 4. Retainer 62 illustratively includes a deck grip 72 and a limiter grip 74. Deck grip 72 extends from exterior deck 66 of rail receiver 60 toward spindle-motion limiter 68 of rail receiver 60 and engages back side 454 of main panel 30. Limiter grip 74 extends from spindle-motion limiter 68 of rail receiver 60 toward exterior deck 66 of rail receiver 60 and engages back side 454 of main panel 30.

Deck grip 72 illustratively includes a left barb 75 and a right barb 76 as shown in FIG. 4. Each barb 75, 76 is formed to include an inwardly-facing retention surface 81 and an outwardly-facing installation ramp 82. Inwardly-facing retention surface 81 engages back side 454 of main panel 30 and blocks movement of C-shaped rail receiver 60 away from top rails 45, 55 of panels 30, 32. Outwardly-facing installation ramps 82 are inclined toward deck-support spine 64 and spindle-motion limiter 68 and encourage exterior deck 66 to move away from spindle-motion limiter 68 to open rail receiver 60 when top panel-motion blocker 35 is pushed into engagement with top rails 45, 55 of panels 30, 32.

Limiter grip 74 illustratively includes a left barb 77, a central barb 78, and a right barb 79 as shown in FIG. 4. Each barb 77, 78, 79 is formed to include an inwardly-facing retention surface 83 and an outwardly-facing installation ramp 84. Inwardly-facing retention surface 83 engages back side 454 of main panel 30 and blocks movement of C-shaped rail receiver 60 away from top rails 45, 55 of panels 30, 32. Outwardly-facing installation ramps 84 are inclined toward deck-support spine 64 and exterior deck 66 and encourage spindle-motion limiter 68 to move away from exterior wall 66 to open C-shaped rail receiver 60 when top panel-motion blocker 35 is pushed into engagement with top rails 45, 55 of panels 30, 32.

Bottom panel-motion blocker 35' is substantially similar to top panel-motion blocker 35 inverted for use with bottom rails 46, 56 of panels 30, 32 as suggested in FIG. 1. Additional description of snap-on bottom panel-motion blocker 35' is omitted and description of snap-on top panel-motion blocker 35 is hereby incorporated by reference to apply to bottom panel-motion blocker 35'. Accordingly, similar reference numbers in the prime series (') indicate features that are common between the top panel-motion blocker 35 and the bottom panel-motion blocker 35'.

Gate mount 12 illustratively includes a top peg receiver 91 and a bottom peg receiver 92 as shown in FIG. 1. Top and bottom peg receivers 91, 92 receive and support corresponding top and bottom pivot pegs 41, 42 of main panel 30 to support extensible gate 16 for movement about gate-pivot axis 16A.

Gate retainer 14 illustratively includes a top pin catch 93 and a bottom pin catch 94 as shown in FIG. 1. Top and bottom pin catches 93, 94 receive and selectively block/allow latch pins 51, 52 of extension panel 32 to move relative to pin catches 93, 94 to thereby block or allow pivotable movement of extensible gate 16 about gate-pivot axis 16A.

Panel-motion blockers 35, 35' individually and/or in combination provide tool-less means to affix adjustable gate panels 30, 32 together at a pre-disposed operating width. In the illustrative embodiment, panel-motion blockers 35, 35' are used without mechanical fasteners and are installed/removed without tools. However, in other embodiments, panel-motion blockers 35, 35' may be used in conjunction with fasteners and may be adapted for installation/removal using tools.

Panel-motion blockers 35, 35' are illustratively designed to be not removable easily by a child but are designed to be removable by a caregiver without requiring tools. Panel-motion blockers 35, 35' are extended into the spindle gaps 49G, 59G formed between the vertical spindles 49, 59 of the panels 30, 32. Panel-motion blockers 35, 35' are positionable along any spindle gap 49G or 59G formed along gate panels 30, 32 to establish different widths of extensible gate 16.

The invention claimed is:

1. A gate unit comprising an extensible gate adapted to be extended or retracted to block openings of various widths, the extensible gate includes a main panel and a slidable extension panel supported for lateral sliding movement relative to the main panel to vary the width of the extensible gate, each of the main and extension panels including a top rail, a bottom rail arranged to lie below and in spaced-apart relation to the top rail, and several spindles arranged to interconnect the top and bottom rails and lie in spaced-apart relation to one another to form a spindle gap between each pair of adjacent spindles, and a panel-motion blocker including a spindle-motion limiter arranged to extend through a first one of the spindle gaps formed in the main panel and a second one of the spindle gaps formed in the extension panel and aligned to lie in side-by-side relation to the first spindle gap formed in the main panel and limiter-support means coupled to one of the top rails of the main and extension panels or the bottom rails of the main and extension panels for supporting the spindle-motion limiter in the first and second spindle gaps to engage spindles of the main panel and spindles of the extension panel defining those first and second spindle gaps during attempted lateral sliding movement of the extension panel relative to the main panel so that such lateral sliding movement is blocked to provide the extensible gate with a selected width wherein the spindle-motion limiter has a width extending substantially across a width of the first one of the spindle gaps from adjacent one spindle of a pair of spindles of the several spindles that cooperate to form the first one of the spindle gaps to adjacent another spindle of the pair of spindles that cooperate to form the first one of the spindle gaps.

2. The gate unit of claim 1, wherein the limiter-support means includes an exterior deck arranged to lie in spaced-apart relation to the spindle-motion limiter to locate and trap said one of the top rails of the main and extension panels or the bottom rails of the main and extension panels therebetween to fix the spindle-motion limiter in a substantially stationary position in the first one of the spindle gaps formed in the main panel and the second one of the spindle gaps formed in the extension panel.

3. The gate unit of claim 2, wherein the limiter-support means further includes a deck-support spine coupled to each of the exterior deck and the spindle-motion limiter to retain the exterior deck and the spindle-motion limiter in substantially stationary positions relative to one another and to the main and extension panels to block lateral sliding movement of the extension panel relative to the main panel.

4. The gate unit of claim 3, wherein the exterior deck includes a free end edge arranged to lie in spaced-apart relation to the deck-support spine, the spindle-motion limiter defines an interior deck arranged to extend through the first one of the spindle gaps and second one of the spindle gaps and terminate at a free end edge arranged to lie in spaced-apart relation to the deck-support spine and cooperate with the free end edge of the exterior deck to define a rail-receiving mouth therebetween that is arranged to open in a direction facing away from the deck-support spine, the deck-support spine is made of an elastic material to allow movement of the exterior deck relative to the interior deck during insertion of said one of the top rails of the main and extension panels and the bottom rails of the main and extensional panels into a rail-receiving space bounded by the exterior deck, interior deck, and deck-support spine through the rail-receiving mouth, and the panel-motion blocker further includes rail-engagement means coupled to the free end edges of the exterior and interior decks for spreading the free end edges of the exterior and interior decks apart during insertion of said one of the top rails of the main and extension panels or the bottom rails of the main and extension panels into the rail-receiving space through the rail-receiving mouth in a direction toward the deck-support spine and for retaining said one of the top rails of the main and extension panels or the bottom rails of the main and extension panels in the rail-receiving space upon arrival therein to fix the interior deck in a substantially stationary position in the first one of the spindle gaps and second one of the spindle gaps.

5. The gate unit of claim 4, wherein the rail-engagement means includes an interior barb coupled to the free end edge of the interior deck and formed to include an inclined rail-camming ramp facing away from the deck-support spine and a rail-retaining stop wall facing toward the deck-support spine and an exterior barb coupled to the free end edge of the exterior deck and formed to include an inclined rail-camming ramp facing away from the deck-support spine and a rail-retaining stop wall facing toward the deck-support spine.

6. The gate unit of claim 2, wherein the panel-motion blocker further includes a retainer coupled to at least one of the exterior deck and the spindle-motion limited to retain the panel-motion blocker in a mounted position on said one of the top rails of the main and extension panels or the bottom rails of the main and extension panels and to retain the spindle-motion limiter in a substantially stationary position in the first one of the spindle gaps and second one of the spindle gaps to block relative movement of the main and extension panels.

7. The gate unit of claim 6, wherein the limiter-support means further includes a deck-support spine coupled to each of the exterior deck and the spindle-motion limiter and arranged to lie in spaced-apart relation to the retainer to define a rail-receiving space therebetween and portions of said one of the top rails of the main and extension panels or the bottom rails of the main and extension panels are retained in the rail-receiving space between the deck-support spine and the retainer and between the exterior deck and the spindle-motion limiter when the panel-motion blocker is mounted on said one of the top rails of the main and extension panels or the bottom rails of the main and extension panels.

8. The gate unit of claim 1, wherein the main panel includes a first spindle-gap frame formed to include a main aperture bordered by a first one of the several spindles of the main panel, an adjacent second one of the several spindles of the main panel that is arranged to lie in spaced-apart relation to the first one of the several spindles of the main panel to define the first one of the spindle gaps therebetween, a portion of the top rail of the main panel coupled to the first one of the several spindles and second one of the several spindles of the main panel, and a portion of the bottom rail of the main panel coupled to the first one of the several spindles and second one of the several spindles of the main panel, the extension panel includes a second spindle-gap frame formed to include an extension aperture bordered by a first one of the several spindles of the extension panel, an adjacent second one of the several spindles of the extension panel that is arranged to lie in spaced-apart relation to the first one of the several spindles of the extension panel to define the second spindle gap therebetween, a portion of the top rail of the extension panel coupled to the first one of the several spindles and second one of the several spindles of the extension panel, and a portion of the bottom rail of the extension panel coupled to the first one of the several spindles and second one of the several spindles of the extension panel, and the spindle-motion limiter is arranged to extend through the main aperture formed in the first spindle-gap frame of the main panel and through the extension aperture formed in the second spindle-gap frame of the extension panel.

9. The gate unit of claim 8, wherein the spindle-motion limiter includes a proximal portion coupled to the limiter-support means and arranged to lie outside of the main aperture formed in the first spindle-gap frame of the main panel, a free-end portion arranged to lie in spaced-apart relation to the proximal portion in a position outside of the extension aperture formed in the second spindle-gap frame of the extension panel, and a central portion arranged to interconnect the proximal and free-end portions and extend through the main and extension apertures.

10. The gate unit of claim 9, wherein the limiter-support means includes an exterior deck arranged to lie in spaced-apart relation to the central portion of the spindle-motion limiter to locate therebetween one of the top rails of the main and extension panels or the bottom rails of the main and extension panels and a deck-support spine arranged to interconnect the proximal portion of the spindle-motion limiter and the exterior deck to locate said one of the top rails of the main and extension panels or the bottom rails of the main and extension panels between the exterior deck and the central portion of the spindle-motion limiter.

11. The gate unit of claim 10, wherein the panel-motion blocker further includes a retainer coupled to the free-end portion of the spindle-motion limiter and to the exterior deck to lie in spaced-apart relation to the deck-support spine to locate said one of the top rails of the main and extension panels or the bottom rails of the main and extension panels in a rail-receiving space bounded by the central portion of the spindle-motion limiter, the deck-support spine, the exterior deck, and the retainer to retain the panel-motion block in a mounted position on the main and extension panels and the central portion of the spindle-motion limiter in the main aperture and the extension aperture to block lateral sliding movement of the extension panel relative to the main panel.

12. The gate unit of claim 11, wherein the retainer includes a limiter grip coupled to the free-end portion of the spindle-motion blocker and arranged to extend toward the exterior deck and to lie in spaced-apart relation to the deck-support spine to trap said one of the top rails of the main and extension panels or the bottom rails of the main and extension panels therebetween.

13. The gate unit of claim 11, wherein the retainer includes a deck grip coupled to the exterior deck and arranged to extend toward the free-end portion of the spindle-motion blocker and to lie in spaced-apart relation to the deck-support spine to trap said one of the top rails of the main and extension panels or the bottom rails of the main and extension panels therebetween.

14. A gate unit includes an extensible gate adapted to be extended or retracted to block openings of various widths, the extensible gate includes a main panel and a slidable extension panel supported for lateral sliding movement relative to the main panel to vary the width of the extensible gate, each of the main and extension panels including a top rail, a bottom rail arranged to lie below and in spaced-apart relation to the top rail, and several spindles arranged to interconnect the top and bottom rails and lie in spaced-apart relation to one another to form a respective spindle gap between each pair of adjacent spindles, a top panel-motion blocker coupled to the top rails of the main panel and the extension panel and arranged to extend over the top rails and into and substantially across a width of one of the spindle gaps formed in the main panel and one of the spindle gaps formed in the extension panel to block lateral sliding movement of the extension panel relative to the main panel, and a bottom panel-motion blocker coupled to the bottom rails of the main panel and the extension panel and arranged extend under the bottom rails and substantially across a width of one of the spindle gaps formed in the main panel and one of the spindle gaps formed in the extension panel to block lateral sliding movement of the extension panel relative to the main panel to engage spindles of the main panel and to engage spindles of the extension panel.

15. The gate unit of claim 14, wherein the top panel-motion blocker includes a top spindle-motion limiter arranged to extend into the spindle gap formed in the main panel and the companion spindle gap formed in the extension panel to underlie the top rails and overlie the bottom rails and a top limiter support including a top exterior deck arranged to mate with the top rails and lie in spaced-apart relation to the top spindle-motion limiter to locate portions of the top rails therebetween and a deck-support spine arranged to interconnect the top exterior deck and the top spindle-motion limiter and lie outside the spindle gap formed in the main panel and the companion spindle gap formed in the extension panel.

16. The gate unit of claim 15, wherein the top panel-motion blocker further includes a retainer including a top limiter grip coupled to the top spindle-motion limiter and a top deck grip coupled to the top exterior deck to cooperate with the top limiter grip and the top exterior deck, top spindle-motion limiter, and the top limiter support to retain the top panel-motion blocker in a mounted position on the top rails.

17. The gate unit of claim 16, wherein the top limiter and deck grips cooperate to provide ramp means for engaging the top rails of one of the main and extension panels during movement of the top rails into a top rail-receiving space bounded by the top exterior deck, deck-support spine, and the top spindle-motion limiter to spread the top exterior deck and the top spindle-motion limiter apart so that the top rails can pass therebetween and into the top rail-receiving space to cause a portion of the top rails to be trapped in the top rail-receiving space between the deck-support spine and the top limiter and deck grips.

18. The gate unit of claim 14, wherein the bottom panel-motion blocker includes a bottom spindle-motion limiter arranged to extend into the spindle gap formed in the main panel and the companion spindle gap formed in the extension panel to overlie the bottom rails and a bottom limiter support including a bottom exterior deck arranged to mate with the bottom rails and lie in spaced-apart relation to the bottom spindle-motion limiter to locate portions of the bottom rails therebetween and a deck-support spine arranged to interconnect the bottom exterior deck and the bottom spindle-motion limiter and lie outside the spindle gap formed in the main panel and the companion spindle gap formed in the extension panel.

19. The gate unit of claim 18, wherein the bottom panel-motion blocker further includes a retainer including a bottom limiter grip coupled to the bottom spindle-motion limiter and a bottom deck grip coupled to the bottom exterior deck to cooperate with the bottom limiter grip and the bottom exterior deck, bottom spindle-motion limiter, and the bottom limiter support to retain the bottom panel-motion blocker in a mounted position on the bottom rails.

20. The gate unit of claim 18, wherein the bottom limiter and deck grips cooperate to provide ramp means for engaging the bottom rails of one of the main and extension panels during movement of the bottom rails into a bottom rail-receiving space bounded by the bottom exterior deck, deck-support spine, and the bottom spindle-motion limiter to spread the bottom exterior deck and the bottom spindle-motion limiter apart so that the bottom rails can pass therebetween and into the bottom rail-receiving space to cause a portion of the bottom rails to be trapped in the bottom rail-receiving space between the deck-support spine and the bottom limiter and deck grips.

* * * * *